US011806996B2

(12) United States Patent
Takahashi et al.

(10) Patent No.: US 11,806,996 B2
(45) Date of Patent: Nov. 7, 2023

(54) RECORDING DEVICE AND METHOD OF CONTROLLING RECORDING DEVICE

(71) Applicant: Seiko Epson Corporation, Tokyo (JP)

(72) Inventors: Haruna Takahashi, Ina (JP); Shun Ito, Matsumoto (JP); Keiichi Yato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/651,987

(22) Filed: Feb. 22, 2022

(65) Prior Publication Data

US 2022/0266611 A1 Aug. 25, 2022

(30) Foreign Application Priority Data

Feb. 25, 2021 (JP) ..... 2021-028676

(51) Int. Cl.
*B41J 15/16* (2006.01)
*B65H 23/188* (2006.01)
*B65H 23/192* (2006.01)

(52) U.S. Cl.
CPC ..... *B41J 15/16* (2013.01); *B65H 23/1888* (2013.01); *B65H 23/192* (2013.01); *B65H 2404/143* (2013.01); *B65H 2513/10* (2013.01); *B65H 2515/32* (2013.01); *B65H 2601/272* (2013.01)

(58) Field of Classification Search
CPC .... B41J 15/16; B65H 23/1888; B65H 23/192; B65H 2404/143; B65H 2513/10; B65H 2515/32; B65H 2601/272
See application file for complete search history.

(56) References Cited

U.S. PATENT DOCUMENTS

2012/0087707 A1* 4/2012 Igarashi ..... B41J 11/425 400/611
2017/0348988 A1 12/2017 Nakata

FOREIGN PATENT DOCUMENTS

JP 2017-218238 12/2017

* cited by examiner

*Primary Examiner* — Henok D Legesse
(74) *Attorney, Agent, or Firm* — WORKMAN NYDEGGER

(57) ABSTRACT

In a printer, an accommodating portion accommodates roll paper. A supply roller pair is disposed upstream of a recording unit in a transport direction, and nips the roll paper. The intermediate roller pair is rotatably disposed between the supply roller pair and the accommodating portion, and nips the roll paper. A second motor and a third motor apply tension to the roll paper between the intermediate roller pair and the accommodating portion. A control unit can switch between a first mode and a second mode. In the first mode, first tension is applied to the roll paper between the intermediate roller pair and the accommodating portion. In the second mode, second tension smaller than the first tension is applied.

9 Claims, 5 Drawing Sheets

RECORDING DEVICE AND METHOD OF CONTROLLING RECORDING DEVICE

The present application is based on, and claims priority from JP Application Serial Number 2021-028676, filed on Feb. 25, 2021, the disclosure of which is hereby incorporated by reference herein in its entirety.

BACKGROUND

1. Technical Field

The present disclosure relates to a recording device and a method of controlling a recording device.

2. Related Art

A printing apparatus described in JP-A-2017-218238 includes a recording unit that performs printing to a medium sent out from a roller pair, a feeding portion that feeds the medium to the roller pair, and a winding portion that winds the medium to which printing has been performed. The feeding portion adjusts back tension acting on the medium and between the roller pair and the feeding portion in accordance with a change in front tension acting on the medium and between the roll pair and the winding portion.

In the printing apparatus described in JP-A-2017-218238, skew of the medium or wrinkle of the medium may take place when slack of the medium occurs between the roller pair and the feeding portion. In addition, when the medium is excessively pulled between the roller pair and the feeding portion, the medium cannot be fully transported at the roller pair, which may result in a reduction in accuracy of transporting the medium. In this manner, a failure of transport of the medium may occur in any of the cases: when slack occurs in the medium and when the medium is excessively pulled.

SUMMARY

In order to solve the problem described above, a recording device according to the present disclosure includes an accommodating portion configured to accommodate a long-length medium that is wound, a portion of the long-length medium being configured to be sent out in a transport direction, a recording unit disposed downstream of the accommodating portion in the transport direction and configured to perform recording on the long-length medium, a first roller pair rotatably disposed upstream of the recording unit in the transport direction and configured to nip the long-length medium, a second roller pair rotatably disposed between the first roller pair and the accommodating portion and configured to nip the long-length medium, a first application mechanism configured to apply tension in the transport direction to the long-length medium between the second roller pair and the accommodating portion, and a control unit configured to control a rotating operation of the first roller pair, a rotating operation of the second roller pair, and an operation of the first application mechanism, in which the control unit is configured to switch between a first mode and a second mode by controlling the operation of the first application mechanism, the first mode being a mode in which first tension is applied to the long-length medium between the second roller pair and the accommodating portion, the second mode being a mode in which second tension smaller than the first tension is applied.

A method of controlling a recording device according to the present disclosure provides a method of controlling a recording device including an accommodating portion configured to accommodate a long-length medium that is wound, a portion of the long-length medium being configured to be sent out in a transport direction, a recording unit disposed downstream of the accommodating portion in the transport direction and configured to perform recording on the long-length medium, a first roller pair rotatably disposed upstream of the recording unit in the transport direction and configured to nip the long-length medium, a second roller pair rotatably disposed between the first roller pair and the accommodating portion and configured to nip the long-length medium, and a first application mechanism configured to apply tension in the transport direction to the long-length medium between the second roller pair and the accommodating portion, the method including switching between a first mode and a second mode in accordance with a setting condition, the first mode being a mode in which the first application mechanism applies first tension to the long-length medium between the second roller pair and the accommodating portion, the second mode being a mode in which the first application mechanism applies second tension smaller than the first tension, transporting the long-length medium to which the first tension or the second tension is applied, to a position opposed to the recording unit, and performing, by the recording unit, recording on the long-length medium that is transported.

DESCRIPTION OF EXEMPLARY EMBODIMENTS

Figure 1:
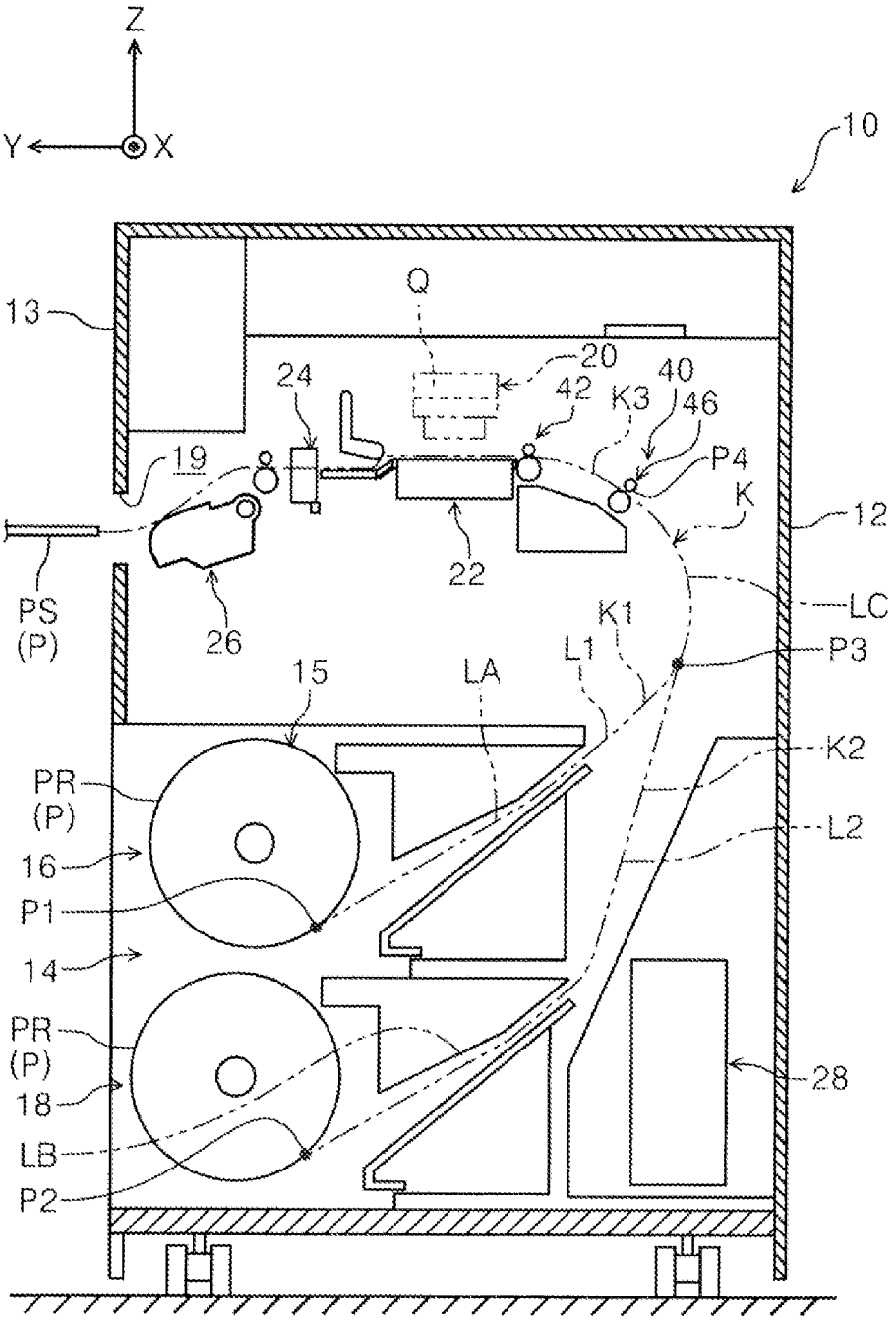
FIG. 1 is a diagram illustrating an entire configuration of a printer according to an embodiment.

Below, a recording device according to first to eleventh aspects of the present disclosure will be schematically described.

A recording device according to a first aspect of the present disclosure provided to solve the problem described above includes: an accommodating portion configured to accommodate a long-length medium that is wound, a portion of the long-length medium being configured to be sent out in a transport direction; a recording unit disposed downstream of the accommodating portion in the transport direction and configured to perform recording on the long-length medium; a first roller pair rotatably disposed upstream of the recording unit in the transport direction and configured to nip the long-length medium; a second roller pair rotatably disposed between the first roller pair and the accommodating portion and configured to nip the long-length medium; a first application mechanism configured to apply tension in the transport direction to the long-length medium between the second roller pair and the accommodating portion; and a control unit configured to control a rotating operation of the first roller pair, a rotating operation of the second roller pair, and an operation of the first application mechanism, in which the control unit is configured to switch between a first mode and a second mode by controlling the operation of the first application mechanism, the first mode being a mode in which first tension is applied to the long-length medium between the second roller pair and the accommodating portion, the second mode being a mode in which second tension smaller than the first tension is applied.

With the present aspect, the second roller pair nips the long-length medium, which makes it easy to vary the tension acting on the long-length medium between the second roller pair and the accommodating portion.

Here, in the first mode, the control unit controls an operation of the first application mechanism to apply the first tension to the long-length medium between the second roller pair and the accommodating portion. This makes it possible to enhance a close-contact property between the second roller pair and a portion of the long-length medium that is wound around the second roller pair, which makes it possible to suppress occurrence of skew and wrinkle of the long-length medium at the second roller pair.

Furthermore, in the second mode, the control unit controls the operation of the first application mechanism to apply the second tension smaller than the first tension to the long-length medium between the second roller pair and the accommodating portion. This makes it possible to prevent excessive tension from being applied to the long-length medium, which makes it possible to prevent an influence of offset of a portion where the long-length medium is wound in a roll form from being exerted on the long-length medium at the second roller pair.

In this manner, it is possible to suppress occurrence of a failure of transport of the long-length medium both when slack occurs in the long-length medium and when the long-length medium is excessively pulled.

In the first aspect, a recording device according to a second aspect includes a second application mechanism configured to apply third tension to the long-length medium between the first roller pair and the second roller pair, in which the control unit controls an operation of the second application mechanism to apply the third tension to the long-length medium between the first roller pair and the second roller pair regardless of the first mode or the second mode.

With the present aspect, regardless of the first mode or the second mode, the third tension acts on the long-length medium between the first roller pair and the second roller pair. This causes the second roller pair to rotate in a followed manner in association with rotation of the first roller pair, which reduces a phase difference in rotation between the first roller pair and the second roller pair. This makes it possible to suppress a reduction in accuracy of transporting the long-length medium at the first roller pair.

In the second aspect, a recording device according to a third aspect is configured such that, in the first mode, the third tension is greater than the first tension.

With the present aspect, the third tension is greater than the first tension at the first roller pair configured to transport the long-length medium on which the third tension acts. This enhances the close-contact property between the long-length medium and the first roller pair. In addition, this also prevents the long-length medium from being excessively pulled toward the upstream side of the second roller pair. Thus, it is possible to suppress a reduction in the accuracy of transporting the long-length medium at the first roller pair. In addition, at the second roller pair configured to transport the long-length medium on which the first tension acts, the long-length medium is pulled toward the upstream side with the first tension smaller than the third tension to suppress slack of the long-length medium. This makes it possible to suppress occurrence of skew or wrinkle of the long-length medium at the second roller pair.

In the second or third aspect, a recording device according to a fourth aspect is configured such that the control unit is configured to receive input of information about a first thickness of the long-length medium and information about a second thickness smaller than the first thickness, and when the information about the second thickness is input, the control unit causes at least the second application mechanism among the first application mechanism and the second application mechanism to operate.

With the present aspect, when the thickness of the long-length medium is relatively small, the second application mechanism applies the third tension to the long-length medium to prevent the long-length medium from being pressurized against the first roller pair in a state of being slack. This makes it possible to suppress occurrence of wrinkle of the long-length medium.

In any one of the second to fourth aspects, a recording device according to a fifth aspect is configured such that the control unit is configured to receive input of information about first transport accuracy that is positional accuracy when the long-length medium is transported and also receive input of information about second transport accuracy of which positional accuracy is higher than the first transport accuracy, and when the information about the second transport accuracy is input, the control unit causes both of the first application mechanism and the second application mechanism to reduce the tension applied to the long-length medium.

With the present aspect, the tension applied to the long-length medium reduces to reduce variation in the tension as compared with a case where the tension is large, which makes it possible to increase the accuracy of transporting the long-length medium.

In any one of the second to fifth aspects, a recording device according to a sixth aspect is configured such that the control unit is configured to receive input of information about a first width of the long-length medium in a width direction intersecting the transport direction, and input of information about a second width narrower than the first width, and the control unit causes both of the first application mechanism and the second application mechanism to increase the tension applied to the long-length medium when the information about the first width is input, and causes both of the first application mechanism and the second application mechanism to reduce the tension applied to the long-length medium when the information about the second width is input.

With the present aspect, when the long-length medium having the second width narrower than the first width is transported, the tension applied to the long-length medium reduces to reduce the variation in the tension as compared with a case where the tension is large, which makes it possible to increase the accuracy of transporting the long-length medium. In a case of the long-length medium having the second width narrower than the first width, wrinkle is less likely to occur as compared with a case of the long-length medium having the first width. Thus, the tension is reduced, and a higher priority is given to the transport accuracy for the long-length medium. In addition, when the long-length medium having the first width wider than the second width is transported, wrinkle is more likely to occur as compared with a case of the long-length medium having the second width. However, by increasing the tension applied to the long-length medium, slack in the transport direction is less likely to occur in the long-length medium. Thus, it is possible to suppress occurrence of wrinkle of the long-length medium.

In any one of the second to sixth aspects, a recording device according to a seventh aspect is configured such that the accommodating portion includes: a first accommodating portion configured to accommodate the long-length medium, a length of a transport path from the first accommodating portion to the second roller pair being a first length; and a second accommodating portion configured to accommodate the long-length medium, a length of a transport path from the second accommodating portion to the second roller pair being a second length longer than the first length, the control unit is configured to receive input of first usage information about use of the first accommodating portion and second usage information about use of the second accommodating portion, and the control unit causes both of the first application mechanism and the second application mechanism to increase the tension applied to the long-length medium when the first usage information is input, and causes both of the first application mechanism and the second application mechanism to reduce the tension applied to the long-length medium when the second usage information is input.

With the present aspect, the length of the transport path when the first usage information is input is the first length shorter than the second length. Here, when the length of the transport path is short, transport load acting on the long-length medium is small. Thus, by increasing the tension applied to the long-length medium, it is possible to suppress warp of the long-length medium.

On the other hand, the length of the transport path when the second usage information is input is the second length longer than the first length. Here, when the length of the transport path is long, the transport load acting on the long-length medium is large. Thus, by reducing the tension applied to the long-length medium, it is possible to prevent the transport load at the time of transporting the long-length medium from excessively increasing.

In any one of the first to seventh aspects, a recording device according to an eighth aspect is configured such that the control unit performs the first mode when first priority information for prioritizing suppression of skew and a wrinkle of the long-length medium is input.

With the present aspect, the first tension is applied to the long-length medium between the second roller pair and the accommodating portion. This makes it possible to enhance the close-contact property between the second roller pair and a portion of the long-length medium that is wound around the second roller pair, and also makes it possible to suppress slack of the long-length medium between the second roller pair and the accommodating portion. Thus, it is possible to suppress occurrence of skew and wrinkle of the long-length medium at the second roller pair.

In any one of the first to eighth aspects, a recording device according to a ninth aspect is configured such that the control unit performs the second mode when second priority information for prioritizing transport accuracy for the long-length medium is input.

With the present aspect, the second tension smaller than the first tension is applied to the long-length medium between the second roller pair and the accommodating portion. This makes it possible to prevent excessive tension from being applied to the long-length medium, which makes it possible to prevent an influence of offset of a portion where the long-length medium is wound in a roll form, from being exerted on the long-length medium at the second roller pair. Thus, it is possible to increase the accuracy of transporting the long-length medium.

In any one of the first to ninth aspects, a recording device according to a tenth aspect is configured such that the first mode is set in the control unit as a mode at a time of start-up.

With the present aspect, the first tension is applied to the long-length medium between the second roller pair and the accommodating portion. This makes it possible to enhance the close-contact property, from the time of startup, between the second roller pair and a portion of the long-length medium that is wound around the second roller pair. This also makes it possible to suppress slack of the long-length medium between the second roller pair and the accommodating portion from the time of startup.

A method of controlling a recording device according to an eleventh aspect provides a method of controlling a recording device including: an accommodating portion configured to accommodate a long-length medium that is wound, a portion of the long-length medium being configured to be sent out in a transport direction; a recording unit disposed downstream of the accommodating portion in the transport direction and configured to perform recording on the long-length medium; a first roller pair rotatably disposed upstream of the recording unit in the transport direction and configured to nip the long-length medium; a second roller pair rotatably disposed between the first roller pair and the accommodating portion and configured to nip the long-length medium; and a first application mechanism configured to apply the tension in the transport direction to the long-length medium between the second roller pair and the accommodating portion, the method including: switching between a first mode and a second mode in accordance with a setting condition, the first mode being a mode in which the first application mechanism applies first tension to the long-length medium between the second roller pair and the accommodating portion, the second mode being a mode in which the first application mechanism applies second tension smaller than the first tension; transporting the long-length medium to which the first tension or the second tension is applied, to a position opposed to the recording unit; and performing, by recording unit, recording on the long-length medium that is transported.

With the present aspect, it is possible to obtain operation and effect similar to those of the recording device according to the first aspect.

Below, specific description will be made of one example of a recording device and a method of controlling a recording device according to the present disclosure.

FIG. 1 illustrates a printer 10 serving as one example of a recording device according to an embodiment.

In each of the drawings, the X direction along the X-axis serves as one example of a device width direction of the printer 10 that will be described later as well as of a width direction of roll paper PR. The −X direction is a left direction as viewed from a user when the front face of the device faces the user, and the +X direction is a right direction.

The Y direction along the Y-axis serves as one example of a device depth direction of the printer 10. The +Y direction is a direction from the back surface of the device toward the front face, and serves as one example of a transport direction for the roll paper PR, which will be described later, in a platen unit 30. The −Y direction is a direction from the front face of the device toward the back surface. The X direction and the Y direction extend in a horizontal direction.

The Z direction along the Z-axis is a device height direction of the printer 10 and the vertical direction. The +Z direction is a vertically upward direction, and the −Z direction is a vertically downward direction. The X direction, the Y direction, and the Z direction are perpendicular to each other.

In the printer 10, roll paper PR is used as one example of a long-length medium elongated in one direction. A portion of the roll paper PR is configured as a roll portion 15 wound around a metal core, which is not illustrated, and is rotatably accommodated in an accommodating portion 14 that will be described later. In addition, a portion of the roll paper PR other than the roll portion 15 is pulled out of the roll portion 15. The roll paper PR is cut by a cut portion 24 that will be described later, into a cut-sheet paper PS having a sheet shape.

A loading device, which is not illustrated, on which the cut-sheet paper PS is loaded is provided in the +Y direction relative to the printer 10. The printer 10 includes a housing 12 having a cuboid shape.

The housing 12 has a side wall 13 that constitutes a wall portion of the housing 12 at the +Y direction. A discharge port 19 that extends in the Y direction is formed in the side wall 13. The discharge port 19 has a size that allows any sheets P that can be used in the printer 10 to pass through.

The printer 10 is configured as an inkjet-type printer that can perform printing on a sheet P having a size ranging from A4 size to A0 size, as one example. The printer 10 can perform recording on ordinary paper or a photo sheet. Specifically, the printer 10 includes an operating panel 11 (FIG. 2), the accommodating portion 14, a recording unit 20, a platen unit 22, the cut portion 24, an emitting unit 26, a control unit 28, a sheet sensor 39 (FIG. 2), and a transport unit 40.

A transport path K through which the roll paper PR or the cut-sheet paper PS is transported is formed from the accommodating portion 14 to the loading device.

With the operating panel 11, it is possible to set either a first mode or a second mode, which will be described later. With the operating panel 11, it is possible to set a first thickness of the roll paper PR and a second thickness smaller than the first thickness. With the operating panel 11, it is possible to select setting of first transport accuracy that is positional accuracy at the time of transporting the roll paper PR and setting of second transport accuracy having positional accuracy higher than the first transport accuracy. With the operating panel 11, it is possible to set a first width of the roll paper PR in a width direction intersecting the transport direction and a second width narrower than the first width. With the operating panel 11, it is possible to select a first accommodating portion 16 and a second accommodating portion 18, which will be described later.

The accommodating portion 14 is configured to accommodate the roll paper PR that has been wound, in a manner such that a portion of the roll paper PR can be sent out. The accommodating portion 14 includes the first accommodating portion 16 and the second accommodating portion 18 that are arranged side by side in the Z direction, as one example.

The first accommodating portion 16 is disposed, in the housing 12, more toward the −Z direction than the center in the Z direction. The first accommodating portion 16 accommodates one piece of roll paper PR. In the transport path K, a transport path for the roll paper PR sent out from the first accommodating portion 16 is set as a transport path K1. In addition, a position at the first accommodating portion 16 where a portion of the roll paper PR is sent out is set as a first delivering position P1.

In the housing 12, the second accommodating portion 18 is disposed at the −Z direction relative to the first accommodating portion 16. The second accommodating portion 18 accommodates another piece of roll paper PR. In the transport path K, a transport path for the roll paper PR sent out from the second accommodating portion 18 is set as a transport path K2. In addition, a position at the second accommodating portion 18 where a portion of the roll paper PR is sent out is set as a second delivering position P2.

The transport path K1 and the transport path K2 are formed as different paths up to a merging position P3, and have a common transport path K3 at a downstream side of the merging position P3.

In the transport path K3, a central position of a nip portion where an intermediate roller pair 46, which will be described later, nips the roll paper PR is set as a nip position P4.

The length from the first delivering position P1 to the merging position P3 is set as LA [mm]. The length from the second delivering position P2 to the merging position P3 is set as LB [mm]. The length from the merging position P3 to the nip position P4 is set as LC [mm]. Note that the length LA, the length LB, and the length LC are lengths set so that the roll paper PR is not in contact with other members, and obtained on the basis of an imaginary line of each of these lengths.

Here, the first length L1 [mm] represents the sum of the length of the transport path K1 from the first accommodating portion 16 to the intermediate roller pair 46 and the length of the transport path K3. The first length L1=LA+LC establishes. In addition, the second length L2 [mm] represents the sum of the length of the transport path K2 from the second accommodating portion 18 to the intermediate roller pair 46 and the length of the transport path K3. The second length L2=LB+LC establishes. The second length L2 is longer than the first length L1.

The recording unit 20 is disposed downstream of the accommodating portion 14 in the transport direction for the roll paper PR, and performs recording on the roll paper PR. Specifically, the recording unit 20 discharges an ink Q serving as one example of a liquid droplet, onto the roll paper PR transported by the transport unit 40 that will be described later, thereby performing recording. Note that the roll paper PR is transported toward the +Y direction in a region that faces the recording unit 20. In addition, the recording unit 20 is disposed at the +Z direction relative to the roll paper PR. In other words, recording is performed to the upper surface of the roll paper PR in the +Z direction.

The platen unit 22 is disposed at the −Z direction relative to the recording unit 20, and is configured to support a portion of the roll paper PR.

The cut portion 24 cuts the roll paper PR on which recording has been performed by the recording unit 20, thereby forming the cut-sheet paper PS.

The emitting unit 26 is configured to emit the cut-sheet paper PS from the discharge port 19 to the outside.

The control unit 28 controls a rotating operation of a supply roller pair 42 that will be described later, a rotating operation of the intermediate roller pair 46, and operations of a first motor 52, a second motor 54, and a third motor 56 that will be described later. Note that details of control by the control unit 28 will be specifically described later.

Figure 2:
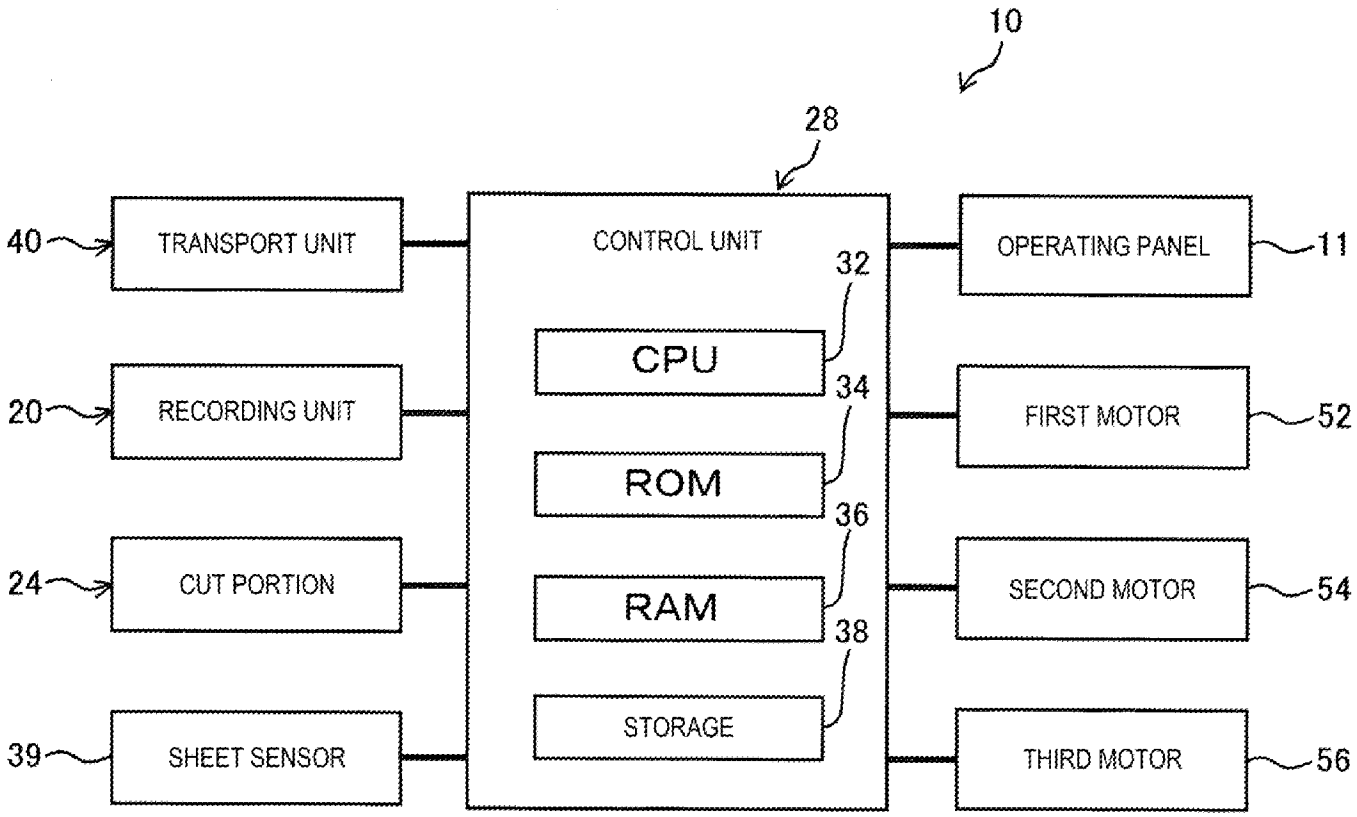
FIG. 2 is a block diagram illustrating each portion of the printer according to the embodiment.

As illustrated in FIG. 2, the control unit 28 functions as a computer. Specifically, the control unit 28 includes a central processing unit (CPU) 32, a read only memory (ROM) 34, a random access memory (RAM) 36, and a storage 38. The ROM 34 holds various types of data including programs executed by the CPU 32. The programs are programs used to cause the CPU 32 to execute each step described later in the printer 10.

A sheet sensor 39 is disposed at or around the merging position P3 (FIG. 1) as one example, and is configured to detect a state of warp of the roll paper PR moving toward the intermediate roller pair 46. In addition, the sheet sensor 39 includes a light emitting portion including a laser diode as one example, and a light-receiving unit configured to receive reflected light from a measurement target object. The distance between the sheet sensor 39 and the roll paper PR can be obtained through a triangulation process or a distance measurement process based on time differences. Note that the method of measuring the distance may be a method using ultrasonic waves.

As illustrated in FIGS. 1 and 2, the transport unit 40 includes the supply roller pair 42, the intermediate roller pair 46, the first motor 52, the second motor 54, and the third motor 56, by way of example. In addition, the transport unit 40 transports the roll paper PR that has been pulled out of the accommodating portion 14, toward the downstream side along the transport path K.

Figure 3:
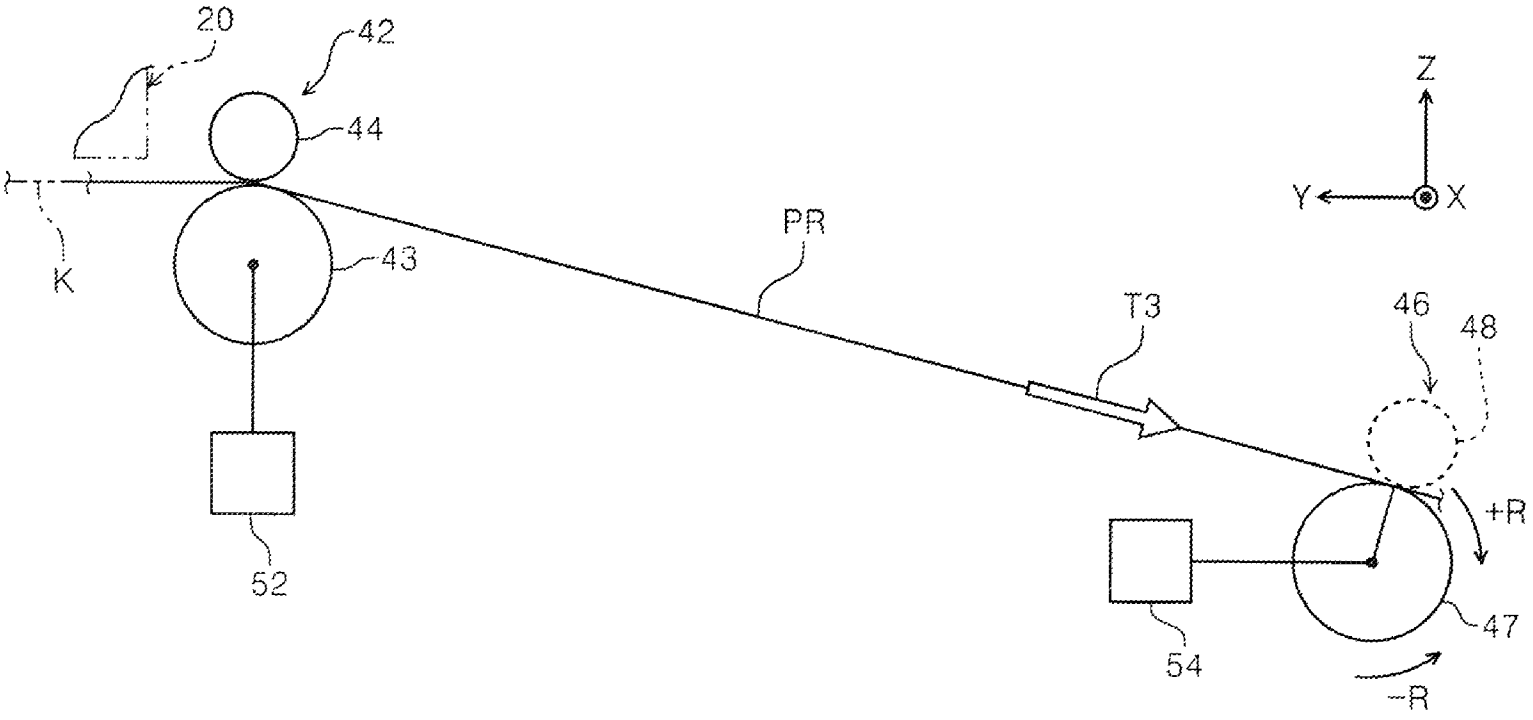
FIG. 3 is a schematic view illustrating a state in which tension acts on roll paper between a first roller pair and a second roller pair in the printer according to the embodiment.

As illustrated in FIG. 3, the supply roller pair 42 serves as one example of the first roller pair, and is rotatably disposed upstream of the recording unit 20 in the transport direction for the roll paper PR to nip the roll paper PR. Specifically, the supply roller pair 42 includes a lower roller 43 and an upper roller 44.

The lower roller 43 is disposed at the −Z direction relative to the transport path K, and is provided rotatably around the central axis along the X direction. In addition, the lower roller 43 is rotationally driven by the first motor 52 that will be described later.

The upper roller 44 is disposed at the +Z direction relative to the transport path K, and is provided rotatably around the central axis along the X direction. Furthermore, the upper roller 44 is rotated in a followed manner in association with rotation of the lower roller 43. The diameter of the upper roller 44 is smaller than the diameter of the lower roller 43, by way of example.

The intermediate roller pair 46 serves as one example of the second roller pair, and is rotatably disposed between the supply roller pair 42 and the accommodating portion 14 to nip the roll paper PR. Specifically, the intermediate roller pair 46 includes a driving roller 47 and a driven roller 48.

The driving roller 47 is disposed at the −Z direction relative to the transport path K, and is provided rotatably around the central axis along the X direction. In addition, the driving roller 47 is rotationally driven by the second motor 54 that will be described later.

The driven roller 48 is disposed at the +Z direction relative to the transport path K, and is provided rotatably around the central axis along the X direction. Furthermore, the driven roller 48 is rotated in a followed manner in association with rotation of the driving roller 47. The diameter of the driven roller 48 is smaller than the diameter of the driving roller 47, by way of example.

Figure 4:
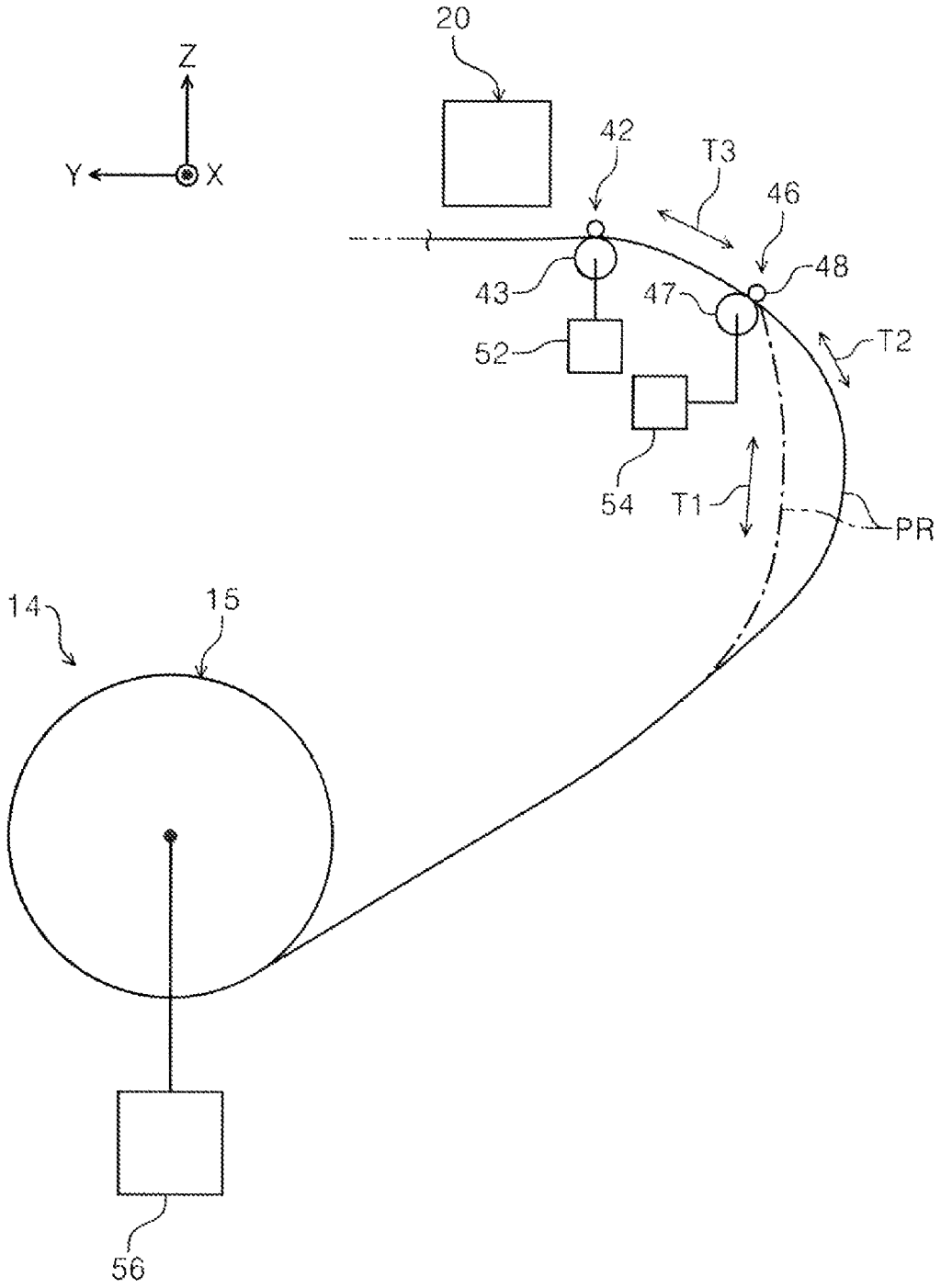
FIG. 4 is a schematic view illustrating a state in which tension acts on roll paper from a delivering roller to the first roller pair in the printer according to the embodiment.

As illustrated in FIG. 4, the first motor 52 is energized by a power supply portion, which is not illustrated, to cause the lower roller 43 to rotationally drive via a gear that is not illustrated.

The second motor 54 is energized by a power supply portion to cause the driving roller 47 to rotationally drive via a gear that is not illustrated.

The third motor 56 is energized by a power supply portion to cause the roll portion 15 of the roll paper PR to rotationally drive via a gear that is not illustrated.

The second motor 54 and the third motor 56 each serve as one example of the first application mechanism, and are configured to apply the tension in the transport direction to the roll paper PR between the intermediate roller pair 46 and the accommodating portion 14. Specifically, the second motor 54 and the third motor 56 are configured so as to be able to apply first tension T1 or second tension T2 smaller than the first tension T1 in the transport direction to the roll paper PR between the intermediate roller pair 46 and the accommodating portion 14.

The third motor 56 functions as a first adjustment unit configured to adjust the tension acting on the roll paper PR between the intermediate roller pair 46 and the accommodating portion 14. In other words, in a state where the second motor 54 drives the driving roller 47 with a certain setting, the third motor 56 changes a state of driving the roll portion 15 to adjust the tension acting on the roll paper PR between the intermediate roller pair 46 and the accommodating portion 14. This makes it possible to switch between the first tension T1 and the second tension T2.

The first motor 52 and the second motor 54 each serve as one example of the second application mechanism, and are configured to apply third tension T3 in the transport direction to the roll paper PR between the supply roller pair 42 and the intermediate roller pair 46.

The second motor 54 functions as the second adjustment unit configured to adjust the third tension T3 acting on the roll paper PR between the supply roller pair 42 and the intermediate roller pair 46. In other words, in a state where the first motor 52 drives the lower roller 43 with a certain setting, the second motor 54 changes a state of driving the driving roller 47 to adjust the third tension T3.

Description will be made of a method of adjusting the third tension T3 acting on the roll paper PR between the supply roller pair 42 and the intermediate roller pair 46, as illustrated in FIG. 3. Note that description of the driven roller 48 will not be made for the purpose of simplification.

"Fr" represents a load required for the second motor 54 to rotate the driving roller 47. In addition, the reduction ratio of the driving roller 47 is set to "m" and the radius of the driving roller 47 is set to "r". Furthermore, "Fa" represents an assist torque when the driving roller 47 rotates with the drive by the second motor 54.

In a non-assist state where a current required for the driving roller 47 to rotate in the transport direction is not caused to flow through the second motor 54, the third tension T3A is T3A=Fr×m/r. In an assisted state where a current required for the driving roller 47 to rotate in the transport direction is caused to flow through the second motor 54, the third tension T3B is T3B=(Fr−Fa)×m/r. The value of the electric current flowing through the second motor 54 in the assisted state may be a value of the electric current that causes the driving roller 47 to rotate. However, it may be possible to set it to a value of the electric current that can assist the supply roller pair 42 in transporting the roll paper PR even if the value of the electric current is not enough to rotate the driving roller 47.

Here, as the value of the electric current caused to flow through the second motor 54 decreases, the Fa decreases. In this case, the third tension T3B is brought close to the third tension T3A, which results in an increase in the tension.

On the other hand, as the value of the electric current caused to flow through the second motor 54 increases, the Fa increases. In this case, the third tension T3B is smaller than the third tension T3A, and the minimum value thereof is zero.

In this manner, by varying the value of the electric current of the second motor 54, the assist torque Fa varies, and it is possible to adjust the third tension T3.

Note that, at the time of adjusting the tension acting on the roll paper PR between the intermediate roller pair 46 and the accommodating portion 14, it is only necessary, in the description above, to replace the supply roller pair 42 with the intermediate roller pair 46, and replace the intermediate roller pair 46 with the roll portion 15 to make adjustment by using the third motor 56. Thus, explanation thereof will not be made.

Next, control performed by the control unit 28 will be specifically described with reference to FIGS. 1 to 4.

The control unit 28 can switch between a first mode and a second mode by controlling operations of the second motor 54 and the third motor 56. The first mode is a mode in which the first tension T1 is applied to the roll paper PR between the intermediate roller pair 46 and the accommodating portion 14, and the second mode is a mode in which the second tension T2 is applied. For example, the first tension T1 can be changed into the second tension T2 by operating the third motor 56 to increase the amount of the roll paper PR sent out from the accommodating portion 14.

In addition, the control unit 28 controls operations of the first motor 52 and the second motor 54 to apply the third tension T3 to the roll paper PR between the supply roller pair 42 and the intermediate roller pair 46 regardless of the first mode or the second mode. Note that the control unit 28 performs controlling so that the third tension T3 is greater the first tension T1 in the first mode.

Information about a first thickness d1 of the roll paper PR and information about a second thickness d2 smaller than the first thickness d1 can be input into the control unit 28 from the operating panel 11. The first thickness d1 and the second thickness d2 are not illustrated in the drawing.

When the information about the second thickness d2 is input from the operating panel 11, the control unit 28 causes at least the first motor 52 and the second motor 54 from among the first motor 52, the second motor 54, and the third motor 56 to operate.

Information about the first transport accuracy that is the positional accuracy at the time of transporting the roll paper PR and information about the second transport accuracy having positional accuracy higher than the first transport accuracy can be input into the control unit 28 from the operating panel 11. In other words, the operating panel 11 enables the positional accuracy of the roll paper PR to be selected between a normal mode with a normal positional accuracy and a high accuracy mode with a high positional accuracy.

When the information about the second transport accuracy is input, the control unit 28 reduces the tension applied to the sheet P at the first motor 52 and the second motor 54 as well as at the second motor 54 and the third motor 56, as compared with a case where the information about the first transport accuracy is input. That is, the third tension T3 and the first tension T1 or the second tension T2 are reduced.

Information about a first width W1 of the roll paper PR in the X direction intersecting the transport direction and information about a second width W2 narrower than the first width W1 can be input into the control unit 28 from the operating panel 11. The first width W1 and the second width W2 are not illustrated in the drawing.

At the first motor 52 and the second motor 54 as well as at the second motor 54 and the third motor 56, the control unit 28 increases the tension applied to the roll paper PR when the information about the first width W1 is input, and reduces the tension applied to the roll paper PR when the information about the second width W2 is input. In other words, the third tension T3 and the first tension T1 or the second tension T2 are increased at the time of the first width W1. The third tension T3 and the first tension T1 or the second tension T2 are decreased at the time of the second width W2.

First usage information about use of the first accommodating portion 16 and second usage information about use of the second accommodating portion 18 can be input into the control unit 28 from the operating panel 11.

At first motor 52 and the second motor 54 as well as at the second motor 54 and the third motor 56, the control unit 28 increases the tension applied to the roll paper PR when the first usage information is input, and reduces the tension applied to the roll paper PR when the second usage information is input. In other words, the third tension T3 and the first tension T1 or the second tension T2 are increased at the time of the first usage information. The third tension T3 and the first tension T1 or the second tension T2 are decreased at the time of the second usage information.

Note that these changes to increase or decrease may be made to the tension that has been set in advance, or may be made to the tension that is acting at the time when various types of information are input.

The control unit 28 performs the first mode described above when first priority information for prioritizing suppression of skew and a wrinkle of the roll paper PR is input at the operating panel 11.

In addition, the control unit 28 performs the second mode described above when second priority information for prioritizing accuracy of transporting the roll paper PR is input at the operating panel 11.

Furthermore, at the time of start-up, the first mode described above is set in the control unit 28 as a mode.

Next, operation of the printer 10 and a method of controlling the printer 10 according to the embodiment will be described.

Figure 5:
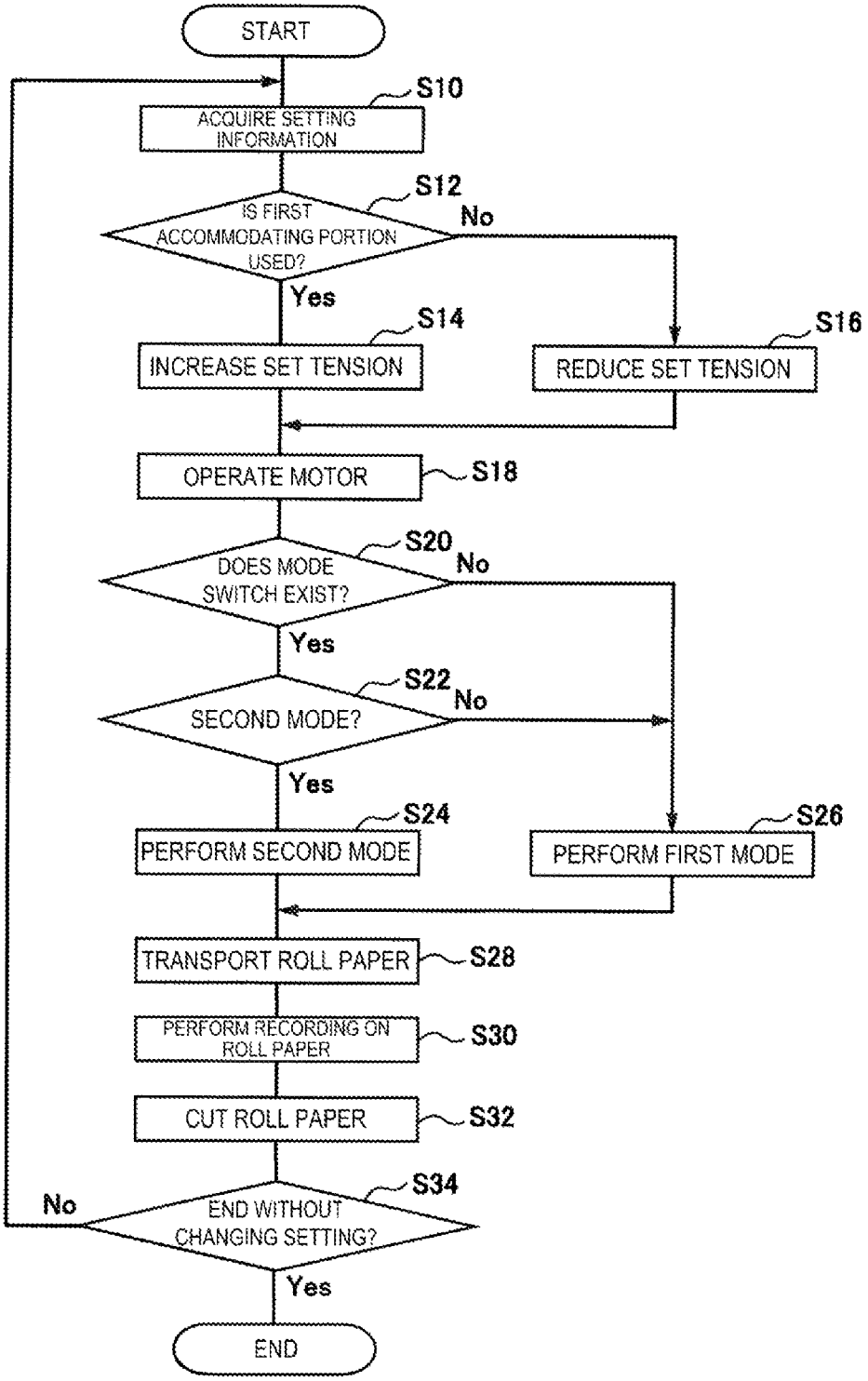
FIG. 5 is a flowchart showing a flow of individual processes executed by the printer according to the embodiment.

FIG. 5 is a flowchart showing a flow of individual processes in the printer 10.

Note that reference should be made to FIGS. 1 to 4 as to individual portions and individual members that constitute the printer 10, and individual figure numbers will not be described. Each of the processes shown in FIG. 5 is performed by the CPU 32 reading a program PR from the ROM 34 and developing it on the RAM 36 to execute it.

In step S10, the CPU 32 acquires various types of setting information set through the operating panel 11. Various types of setting information includes: selection information about the first mode and the second mode; selection information about the first thickness d1 and the second thickness d2; selection information about the normal mode and the high accuracy mode; selection information about information regarding the first width W1 and the second width W2; selection information about the first usage information and the second usage information; and selection information about the first priority information and the second priority information. Note that the first mode is set as the initial state. Then, the process proceeds to step S12.

In step S12, the CPU 32 determines whether or not to use the first accommodating portion 16, on the basis of the setting information. When the first accommodating portion 16 is used (S12: Yes), the process proceeds to step S14.

When the second accommodating portion 18 is used (S12: No), the process proceeds to step S16.

In step S14, the CPU 32 increases a set tension serving as the target from among the set tensions of the first tension T1, the second tension T2, and the third tension T3. Then, the process proceeds to step S18.

In step S16, the CPU 32 reduces a set tension serving as the target from among set tensions of the first tension T1, the second tension T2, and the third tension T3. Then, the process proceeds to step S18.

In step S18, the CPU 32 causes a motor serving as the operation target from among the first motor 52, the second motor 54, and the third motor 56 to operate on the basis of the setting information. Then, the process proceeds to step S20.

In step S20, the CPU 32 determines whether or not a switch between the first mode and the second mode exists, on the basis of the setting information. When the switch between the first mode and the second mode exists (S20: Yes), the process proceeds to step S22. When the switch between the first mode and the second mode does not exist (S20: No), the process proceeds to step S26.

In step S22, the CPU 32 determines whether or not the second mode is selected. When the second mode is selected (S22: Yes), the CPU 32 switches from the first mode to the second mode, and the process proceeds to step S24. When the first mode is selected (S22: No), the CPU 32 keeps the first mode, and the process proceeds to step S26.

In step S24, the CPU 32 performs the second mode. Then, the process proceeds to step S28.

In step S26, the CPU 32 performs the first mode. Then, the process proceeds to step S28.

In step S28, the CPU 32 transports a non-recorded portion of the roll paper PR to a position opposed to the recording unit 20. Then, the process proceeds to step S30.

In step S30, the CPU 32 causes the recording unit 20 to perform recording on the roll paper PR that is transported. Then, the process proceeds to step S32.

In step S32, the CPU 32 actuates the cut portion 24 to cause it to cut the roll paper PR. Then, the process proceeds to step S34.

In step S34, the CPU 32 checks whether or not the number of pieces of cut-sheet paper PS formed reaches a set number, and also checks the presence or absence of input of additional information from the operating panel 11 to determine whether or not to end the process without changing various types of settings. When the process ends without changing settings (S34: Yes), the program ends. When a setting is changed (S34: No), the process proceeds to step S10.

With the printer 10, the intermediate roller pair 46 nips the roll paper PR. This makes it easy to change the tension acting on the roll paper PR between the intermediate roller pair 46 and the accommodating portion 14.

Here, in the first mode, the control unit 28 controls operations of the second motor 54 and the third motor 56 to apply the first tension T1 to the roll paper PR between the intermediate roller pair 46 and the accommodating portion 14. This enhances the close-contact property between the intermediate roller pair 46 and a portion of the roll paper PR that is wound around the intermediate roller pair 46, which makes it possible to suppress occurrence of skew and wrinkle of the roll paper PR at the intermediate roller pair 46.

In addition, in the second mode, the control unit 28 controls operations of the second motor 54 and the third motor 56 to apply the second tension T2 smaller than the first tension T1 to the roll paper PR between the intermediate roller pair 46 and the accommodating portion 14. This prevents excessive tension from being applied to the roll paper PR. Thus, it is possible to prevent an influence of offset of the roll portion 15 where the roll paper PR is wound in a roll form, from being exerted on the roll paper PR at the intermediate roller pair 46.

In this manner, it is possible to suppress occurrence of a failure of transport of the roll paper PR both when slack occurs in the roll paper PR and when the roll paper PR is excessively pulled.

With the printer 10, regardless of whether the mode is the first mode or the second mode, the third tension T3 acts on the roll paper PR between the supply roller pair 42 and the intermediate roller pair 46. This causes the intermediate roller pair 46 to rotate in a followed manner in association with rotation of the supply roller pair 42, which reduces a phase difference in rotation between the supply roller pair 42 and the intermediate roller pair 46. Thus, it is possible to suppress a reduction in the accuracy of transport of the roll paper PR at the supply roller pair 42.

With the printer 10, the third tension T3 is greater than the first tension T1 at the supply roller pair 42 configured to transport the roll paper PR on which the third tension T3 acts. This enhances the close-contact property between the roll paper PR and the supply roller pair 42. In addition, this also prevents the roll paper PR from being excessively pulled toward the upstream side of the intermediate roller pair 46. Thus, it is possible to suppress a reduction in the accuracy of transport of the roll paper PR at the supply roller pair 42. Furthermore, the roll paper PR is pulled toward the upstream side with the first tension T1 smaller than the third tension T3 at the intermediate roller pair 46 configured to transport the roll paper PR on which the first tension T1 acts. This suppresses slack of the roll paper PR. Thus, it is possible to suppress occurrence of skew and wrinkle of the roll paper PR at the intermediate roller pair 46.

With the printer 10, when the thickness of the roll paper PR is relatively small, the first motor 52 and the second motor 54 apply the third tension T3 to the roll paper PR to prevent the roll paper PR from being pressurized against the supply roller pair 42 in a state of being slack. This makes it possible to suppress occurrence of wrinkle of the roll paper PR.

With the printer 10, when information about the second transport accuracy is input, the tension applied to the roll paper PR reduces, which leads to a reduction in variation in the tension as compared with a case where the tension is large. This makes it possible to enhance the accuracy of transport of the roll paper PR.

With the printer 10, when the roll paper PR having the second width W2 narrower than the first width W1 is transported, the tension applied to the roll paper PR reduces, which leads to a reduction in variation in the tension as compared with a case where the tension is large. This makes it possible to enhance the accuracy of transport of the roll paper PR. In a case of the roll paper PR having the second width W2 narrower than the first width W1, wrinkle is less likely to occur as compared with a case where the roll paper PR has the first width W1. Thus, the tension is reduce to give a higher priority to the accuracy of transport of the roll paper PR. In addition, when the roll paper PR having the first width W1 wider than the second width W2 is transported, wrinkle is more likely to occur as compared with a case of the roll paper PR having the second width W1. However, the tension applied to the roll paper PR is increased to make slack of the roll paper PR less likely to occur in the transport direction. Thus, it is possible to suppress occurrence of wrinkle of the roll paper PR.

With the printer 10, when the first usage information is input, the length of the transport path K is the first length L1 shorter than the second length L2. Here, when the length of the transport path K is short, the transport load acting on the roll paper PR is small. Thus, the tension applied to the roll paper PR increases, which makes it possible to suppress warp of the roll paper PR.

On the other hand, when the second usage information is input, the length of the transport path K is the second length L2 longer than the first length L1. Here, when the length of the transport path K is long, the transport load acting on the roll paper PR is large. Thus, the tension applied to the roll paper PR reduces, which makes it possible to prevent the transport load at the time of transporting the roll paper PR from excessively increasing.

With the printer 10, the first tension T1 is applied to the roll paper PR between the intermediate roller pair 46 and the accommodating portion 14. This enhances the close-contact property between the intermediate roller pair 46 and a portion of the roll paper PR that is wound around the intermediate roller pair 46. In addition, this also suppresses slack of the roll paper PR between the intermediate roller pair 46 and the accommodating portion 14. Thus, it is possible to suppress occurrence of skew and wrinkle of the roll paper PR at the intermediate roller pair 46.

With the printer 10, the second tension T2 smaller than the first tension T1 is applied to the roll paper PR between the intermediate roller pair 46 and the accommodating portion 14. This prevents excessive tension from being applied to the roll paper PR. Thus, it is possible to prevent an influence of offset of the roll portion 15 where the roll paper PR is wound in a roll form, from being exerted on the roll paper PR at the intermediate roller pair 46. This makes it possible to increase the accuracy of transport of the roll paper PR.

With the printer 10, the first tension T1 is applied to the roll paper PR between the intermediate roller pair 46 and the accommodating portion 14. This enhances the close-contact property between the intermediate roller pair 46 and a portion of the roll paper PR that is wound around the intermediate roller pair 46 from the time of start-up. In addition, this also makes it possible to suppress slack of the roll paper PR between the intermediate roller pair 46 and the accommodating portion 14 from the time of start-up.

With the method of controlling the printer 10, it is possible to obtain operation and effect similar to those of the printer 10.

The printer 10 according to the embodiment of the present disclosure basically has the configuration described above. However, as a matter of course, it is possible to make modification or omission or the like of a partial configuration without departing from the main point of the disclosure of the present application.

In the printer 10, different degrees of tension may be set for the third tension T3 in the first mode and the third tension T3 in the second mode. In the first mode, the third tension T3 may be equal to the first tension T1. In a case of the second thickness d2, only the second motor 54 and the third motor 56 may be operated. When information about the second transport accuracy is input, either the first application mechanism or the second application mechanism may reduce the tension applied to the roll paper PR.

In the printer 10, the equivalent tension may be applied regardless of whether the roll paper PR has the first width W1 or has the second width W2. When a switch is made between the first accommodating portion 16 and the second accommodating portion 18, the tension applied to the roll paper PR may not be changed. The first mode and the second mode may be switched regardless of whether the first priority information is input or the second priority information is input. At the time of start-up, the second mode may be set.

In the printer 10, a plurality of pieces of the roll paper PR may be arranged side by side in the X direction.

The first application mechanism and the second application mechanism are not limited to the configuration in which the value of the electric current flowing through the motor is controlled to vary the assist torque. For example, the roller pair that nips the roll paper PR may be displaced to vary the tension acting on the roll paper PR. In addition, the first application mechanism and the second application mechanism may have a configuration that includes a tension roller.

It may be possible to operate mainly the second motor 54, as another example of the first application mechanism. It may be possible to operate mainly the first motor 52, as another example of the second application mechanism.

In the printer 10, the first mode and the second mode may be switched on the basis of a density of record to the roll paper PR, for example, of the average value of the density of record per surface. For example, when the average value of the density of record is high, there is a possibility that the rigidity of the roll paper PR reduces. Thus, it is considered that the tension is increased when a higher priority is given to suppression of warp of the roll paper PR, or the tension is reduced when the roll paper PR is prevented from being ripped.

What is claimed is:

1. A recording device comprising:

an accommodating portion configured to accommodate a long-length medium that is wound, a portion of the long-length medium being configured to be sent out in a transport direction;

a recording unit disposed downstream of the accommodating portion in the transport direction and configured to perform recording on the long-length medium;

a first roller pair rotatably disposed upstream of the recording unit in the transport direction and configured to nip the long-length medium;

a second roller pair rotatably disposed between the first roller pair and the accommodating portion and configured to nip the long-length medium;

a first application mechanism configured to apply tension in the transport direction to the long-length medium between the second roller pair and the accommodating portion;

a second application mechanism configured to apply third tension to the long-length medium between the first roller pair and the second roller pair; and a control unit configured to control a rotating operation of the first roller pair, a rotating operation of the second roller pair, and an operation of the first application mechanism, wherein the control unit is configured to switch between a first mode and a second mode by controlling the operation of the first application mechanism, the first mode being a mode in which first tension is applied to the long-length medium between the second roller pair and the accommodating portion, the second mode being a mode in which second tension smaller than the first tension is applied, the control unit controls an operation of the second application mechanism to apply the third tension to the long-length medium between the first roller pair and the second roller pair in both of the first mode and the second mode, the control unit is configured to receive input of information about a first width of the long-length medium in a width direction intersecting the transport direction, and input of information about a second width narrower than the first width, and the control unit causes both of the first application mechanism and the second application mechanism to increase tension applied to the long-length medium when the information about the first width is input, and causes both of the first application mechanism and the second application mechanism to reduce tension applied to the long-length medium when the information about the second width is input.

2. The recording device according to claim 1, wherein, in the first mode, the third tension is greater than the first tension.

3. The recording device according to claim 1, wherein the control unit is configured to receive input of information about a first thickness of the long-length medium and information about a second thickness smaller than the first thickness, and when the information about the second thickness is input, the control unit causes at least the second application mechanism, among the first application mechanism and the second application mechanism, to operate.

4. The recording device according to claim 1, wherein the control unit is configured to receive input of information about first transport accuracy that is positional accuracy when the long-length medium is transported and also receive input of information about second transport accuracy of which positional accuracy is higher than the first transport accuracy, and when the information about the second transport accuracy is input, the control unit causes both of the first application mechanism and the second application mechanism to reduce tension applied to the long-length medium.

5. The recording device according to claim 1, wherein the control unit performs the first mode when first priority information for prioritizing suppression of skew and a wrinkle of the long-length medium is input.

6. The recording device according to claim 1, wherein the control unit performs the second mode when second priority information for prioritizing transport accuracy for the long-length medium is input.

7. The recording device according to claim 1, wherein the first mode is set, in the control unit, as a mode at a time of start-up.

8. A recording device comprising:

an accommodating portion configured to accommodate a long-length medium that is wound, a portion of the long-length medium being configured to be sent out in a transport direction;

a recording unit disposed downstream of the accommodating portion in the transport direction and configured to perform recording on the long-length medium;

a first roller pair rotatably disposed upstream of the recording unit in the transport direction and configured to nip the long-length medium;

a second roller pair rotatably disposed between the first roller pair and the accommodating portion and configured to nip the long-length medium;

a first application mechanism configured to apply tension in the transport direction to the long-length medium between the second roller pair and the accommodating portion;

a second application mechanism configured to apply third tension to the long-length medium between the first roller pair and the second roller pair; and a control unit configured to control a rotating operation of the first roller pair, a rotating operation of the second roller pair, and an operation of the first application mechanism, wherein the control unit is configured to switch between a first mode and a second mode by controlling the operation of the first application mechanism, the first mode being a mode in which first tension is applied to the long-length medium between the second roller pair and the accommodating portion, the second mode being a mode in which second tension smaller than the first tension is applied, the control unit controls an operation of the second application mechanism to apply the third tension to the long-length medium between the first roller pair and the second roller pair in both of the first mode and the second mode, the accommodating portion includes:

a first accommodating portion configured to accommodate the long-length medium, a length of a transport path from the first accommodating portion to the second roller pair being a first length; and a second accommodating portion configured to accommodate the long-length medium, a length of a transport path from the second accommodating portion to the second roller pair being a second length longer than the first length, the control unit is configured to receive input of first usage information about use of the first accommodating portion and second usage information about use of the second accommodating portion, and the control unit causes both of the first application mechanism and the second application mechanism to increase tension applied to the long-length medium when the first usage information is input, and causes both of the first application mechanism and the second application mechanism to reduce tension applied to the long-length medium when the second usage information is input.

9. A method of controlling a recording device including:

an accommodating portion configured to accommodate a long-length medium that is wound, a portion of the long-length medium being configured to be sent out in a transport direction;

a recording unit disposed downstream of the accommodating portion in the transport direction and configured to perform recording on the long-length medium;

a first roller pair rotatably disposed upstream of the recording unit in the transport direction and configured to nip the long-length medium;

a second roller pair rotatably disposed between the first roller pair and the accommodating portion and configured to nip the long-length medium; and a first application mechanism configured to apply tension in the transport direction to the long-length medium between the second roller pair and the accommodating portion, the method comprising:

switching between a first mode and a second mode in accordance with a setting condition, the first mode being a mode in which the first application mechanism applies first tension to the long-length medium between the second roller pair and the accommodating portion, the second mode being a mode in which the first application mechanism applies second tension smaller than the first tension;

transporting the long-length medium to which the first tension or the second tension is applied, to a position opposed to the recording unit; and performing, by the recording unit, recording on the long-length medium that is transported, wherein the first mode is set as a mode at a time of start-up.

* * * * *